United States Patent [19]

Van Niel

[11] 4,104,622

[45] Aug. 1, 1978

[54] MONITOR ACTUATING DEVICE AND REUSABLE FASTENER THEREFOR

[75] Inventor: Clarence R. Van Niel, North Olmsted, Ohio

[73] Assignee: Eaton Corporation, Cleveland, Ohio

[21] Appl. No.: 636,901

[22] Filed: Dec. 2, 1975

[51] Int. Cl.[2] ..... G08B 21/00; A44B 9/00

[52] U.S. Cl. ..... 340/572; 24/110; 24/150 R

[58] Field of Search ..... 24/150 R, 155 R, 155 BB, 24/155 RB, 49 CP, 216, 217, 90 E, 108, 110, 211 L, 90 F, 90 PR, 150 FP, 155 BR; 340/280, 258 D

[56] References Cited

U.S. PATENT DOCUMENTS

| | | | |
|---|---|---|---|
| 716,888 | 12/1902 | Hancock | 24/155 RB |
| 1,981,813 | 11/1934 | Schuster | 24/150 R |
| 3,858,280 | 1/1975 | Martens | 24/150 R |
| 3,911,534 | 10/1975 | Martens et al. | 340/280 |
| 3,973,418 | 8/1976 | Close | 24/108 |

FOREIGN PATENT DOCUMENTS

| | | | |
|---|---|---|---|
| 571,215 | 2/1933 | Fed. Rep. of Germany | 24/108 |
| 243,172 | 6/1946 | Switzerland | 24/110 |

*Primary Examiner*—Kenneth J. Dorner
*Attorney, Agent, or Firm*—R. J. McCloskey; H. D. Gordon

[57] ABSTRACT

A monitor actuating device and a releasable, reusable fastener therefor is provided. The monitor actuating device is designed for attachment to a monitored article and for release therefrom only by the use of a specially designed tool. The actuating device includes a pin member, such as a headed tack or the like, extending therefrom and/or therethrough, which is designed to pierce the monitored article, such as an article of clothing or the like. The reusable fastener is selectively attachable to the free end of the pin member to capture the monitored article and/or the monitor actuating device on the pin and to prevent removal of the monitored article and/or the monitor actuating device from the pin. The reusable fastener is designed for release from the pin only upon the use of a special tool to prevent, or at least render more difficult, the unauthorized removal of the monitor actuating device from the monitored article. The fastener includes a body, preferably plastic, in which a resilient spring steel clip is mounted. The body defines a pin receiving bore and the clip includes a resilient generally dome shaped portion, concave side towards the opening to the bore, having an aperture therein aligned with the bore. The aperture has a cross-section with at least one dimension smaller than the diameter of the shaft of the pin. A plurality of generally radially extending slits in the dome intersect the aperture and divide that portion of the dome shaped portion surrounding the aperture into a plurality of resilient spring fingers. The spring fingers will be resiliently deflected radially outwardly upon the application of an axial force to the concave surface of the dome shaped portion to increase the cross-section of the aperture. The body includes an axially movable portion for engagement with the concave surface of the dome shaped portion of the clip. The clip is preferably axially fixed and freely rotatable relative to the body.

18 Claims, 11 Drawing Figures

FIG. 8
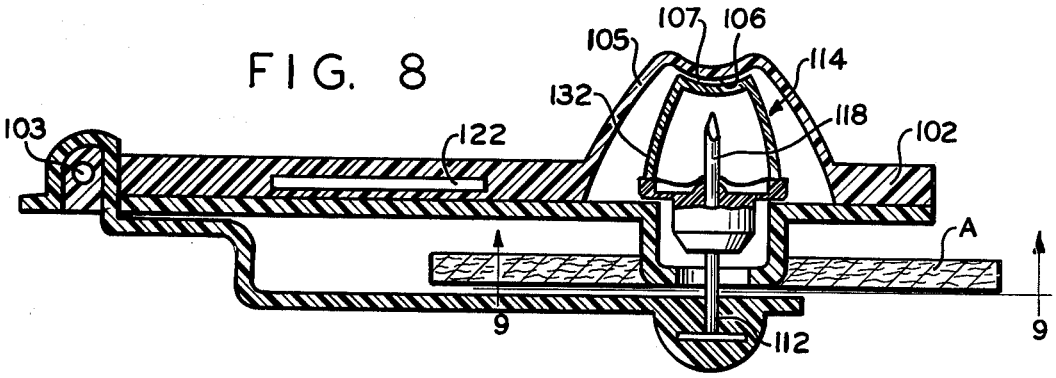
FIG. 9
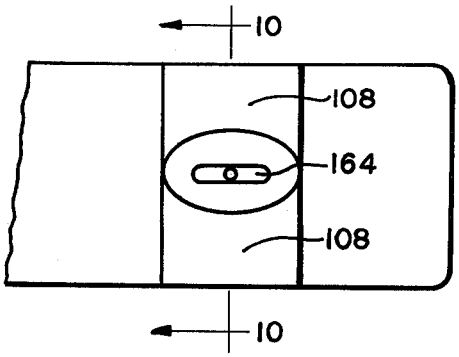
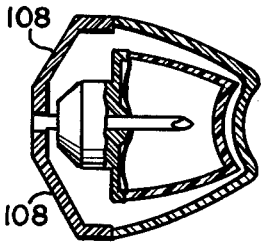
FIG. 10
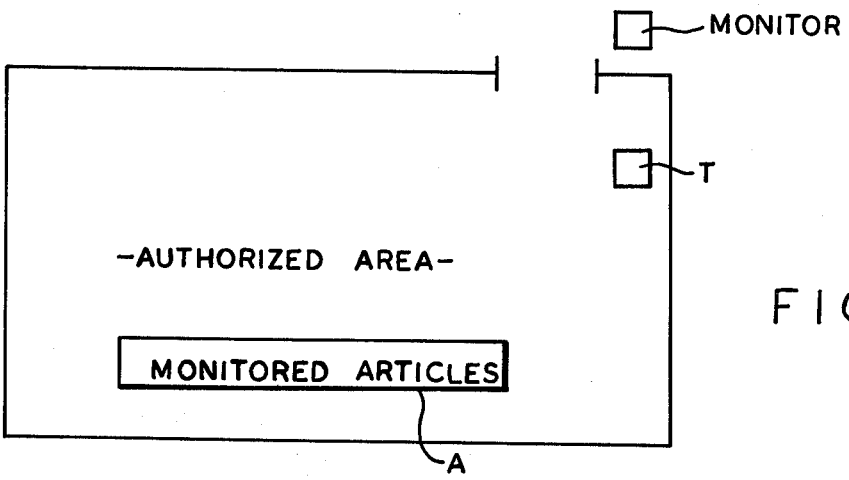
FIG. 11

MONITOR ACTUATING DEVICE AND REUSABLE FASTENER THEREFOR

BACKGROUND OF THE INVENTION

1. Field of the invention

This invention relates to monitor actuating devices and resuable fasteners therefor and more particularly to reusable fasteners which are selectively removably attachable to pin members extending through a monitored article and through and/or from a monitor actuating device to capture the article and/or actuating device on the pin and which are designed to be nondestructively releasable from the pin only upon the use of a special tool.

DESCRIPTION OF THE PRIOR ART

The use of monitor actuating devices such as alarms and alarm-activating members attached to articles to signal the unauthorized removal of said articles beyond a monitored point or from a monitored area is known in the art. Several of these anti-shoplifting systems are described in some detail in U.S. Pat. Nos. 3,665,448; 3,631,442; 3,577,136 and others. In general, the systems comprise a monitor activating device such as a magnet, a miniature circuit, a radio transmitter, or the like which may be releasably attached to an article and a monitoring device which will sound an alarm and/or take a photograph if the activating device is sensed at the monitoring point. The monitoring point is usually located at or beyond the exit of a store, or other designated area. In theory, the activating devices should be easily attached to the articles, easily removed by authorized personnel having the proper equipment and very difficult to remove without the proper equipment, especially for the amateur shoplifter who is responsible for the major portion of shoplifting losses. The activating devices should also be reusable and non-destructive to the articles to which they are attached. The specially provided tool should be difficult to simulate with commonly available articles such as pocketknives, screwdrivers or the like and the tool should also be large enough to attach attention in the event of unauthorized use and should be permanently mountable at an authorized use point, such as a cash register or the like.

Several devices have been utilized in the prior art to attach such activating devices to articles to be protected. Heat-releasable devices of both the melted member type and the bi-metallic lever type have been utilized. These heat-releasable devices have not been totally satisfactory as they have not always been resuable, they are relatively expensive to manufacture, they are somewhat difficult and time consuming to remove and they require a heat-generating tool which may injure the article, the activating member and/or the user.

Devices utilizing special keys have also been used. These devices have proved relatively expense, the keys have proven relatively easy to be misplaced, and the devices have been subject to shoplifters who are somewhat more accustomed to violating key operated devices.

Devices utilizing sensors such as described in U.S. Pat. No. 3,665,448, which signal when the actuating device is removed have also been used. These devices are not totally satisfactory as they require complicated monitoring apparatus, the system must be completely or partially deactivated during authorized removal after payment and removal within the confines of the store will activate the alarm while not necessarily signaling an illegal event which may tend to cause confusion, legal liability and/or non-use of the system.

Releasably attachable clips such as are seen in U.S. Pat. No. 3,914,829 and/or allowed application Ser. No. 497,589 filed Aug. 15, 1974, and assigned to the assignee of this invention have proven satisfactory for many uses. However, these devices involve the use of fasteners which are integral with the monitor actuating mechanism and/or devices wherein two or more sections each carry complementary mating locking portions and thus the monitor actuating mechanism must be replaced in the event of damage to or loss of a portion of the devices.

SUMMARY OF THE INVENTION

In accordance with the present invention, the drawbacks of the prior art have been overcome to the extent that an inexpensively produced, resuable fastener which may be selectively attached to a pin extending from and/or through a monitor actuating device is supplied. The fastener is preferably separate from and independent of the monitor actuating device and is designed for release from a pin which pierces a monitored article and attaches the article to the actuating device only upon the use of a special tool. The fastener includes a body defining a pin receiving bore and a spring steel clip rotatably mounted in the body. The clip includes a base member axially fixed in the body and a resilient generally dome shaped portion, concave side towards the opening to the bore, having an aperture therein aligned with the bore. The aperture has a cross-section with at least one dimension smaller than the diameter of the shaft of the pin. A plurality of generally radially extending slits in the dome shaped portion intersect the aperture and divide that portion of the dome shaped portion surrounding the aperture into a plurality of resilient spring fingers. The spring fingers will deflect radially outwardly upon the application of an axial force to the concave surface of the dome shaped portion to define an aperture of enlarged crosssection. The clip is rotatable relative to the body to prevent the clip from being removed by simple twisting of the fastener. Attempts to axially move the fastener by simply axially forcing the clip from the pin will result in further tightening of the clip on a received pin as the finger will be forced radially inwardly to more tightly engage the pin. The body of the clip includes an axially movable portion which is selectively movable to engage and bear upon the concave surface of the dome shaped portion and force the spring fingers radially outwardly to define an enlarged bore. The axially movable member is movable relative to the remainder of the body by use of a special tool which will apply an axial force to the top of the body and a lateral, radially inwardly directed forced to the sides of the body adjacent the bottom thereof.

Accordingly, it is an object of the present invention to provide a new and improved reusable fastener for attachment to the free end of a pin and designed for nondestructive removal from the pin only upon the use of a specially configured tool.

Another object of the present invention is to provide an improved monitor actuating device including a pin extended therethrough and/or therefrom and a reusable fastener attachable to the pin and releasable only upon the use of a special tool.

A further object of the present invention is to provide a monitor actuating system including a monitor actuator, a pin member extending through and/or from the monitor actuator for piercing the monitored article, a reusable fastener for attachment to the pin and a specialized tool for the selective removal of the fastener from the pin.

These and other objects and advantages of the present invention may be more fully appreciated by a reading of the following description of the preferred embodiment taken in connection with the attached drawings.

FIG. 8 is a front elevational view, in section, of an alternate embodiment of the present invention.

FIG. 9 is a partial bottom view of the embodiment of FIG. 8.

FIG. 10 is a partial side view in section of the embodiment of FIG. 8 taken along the line 10— in FIG. 9.

FIG. 11 is a schematic floor plan of a store or the like utilizing the monitor actuating system of the present invention.

DESCRIPTION OF THE PREFERRED EMBODIMENT

Figure 1:
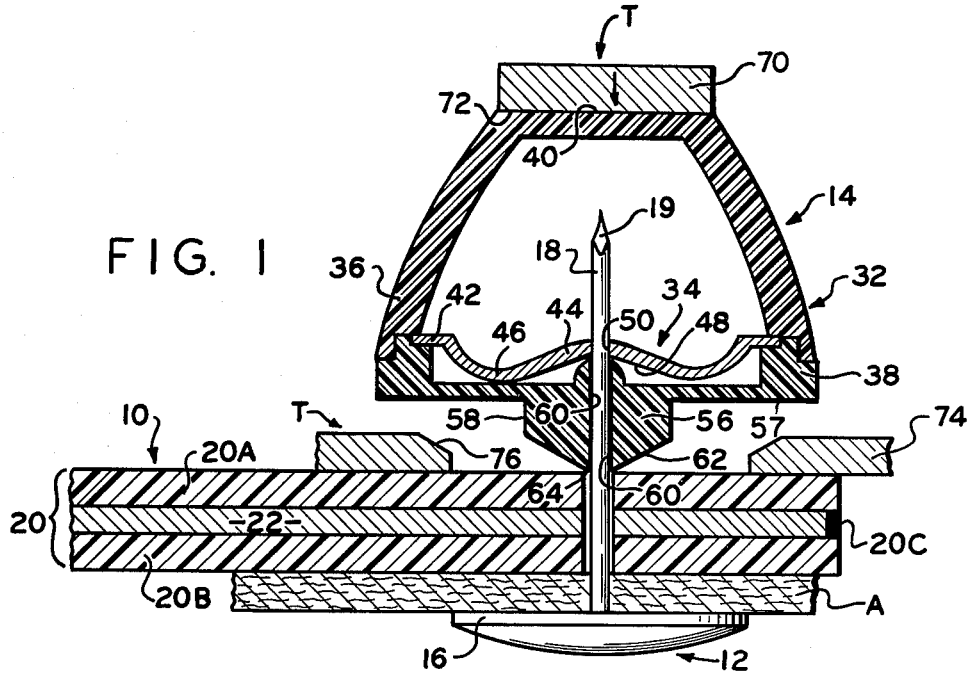
FIG. 1 is a front elevational view in partial section of the monitor actuating system of the present invention including a headed pin piercing a monitored article and extending through a monitor actuating device, a reusable fastener attached to the pin for retaining the monitored article and the monitor actuating device on the pin and the specialized tool for removal of fastener from the pin.
Figure 2:
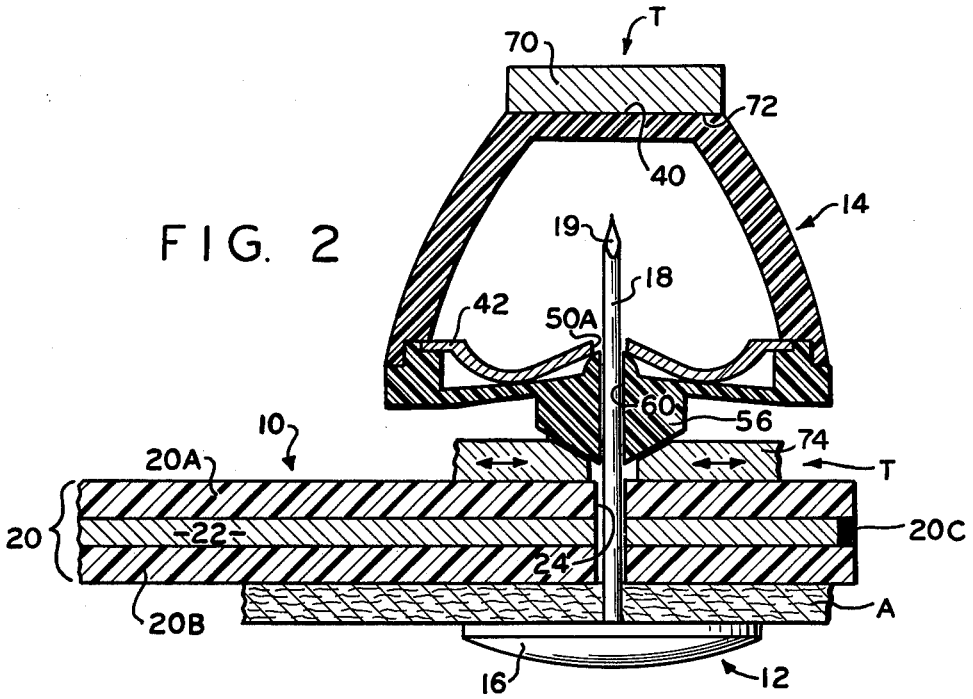
FIG. 2 is a front elevational view of the system of FIG. 1 illustrating the fastener releasing the pin as a result of use of the specialized tool.
Figure 3:
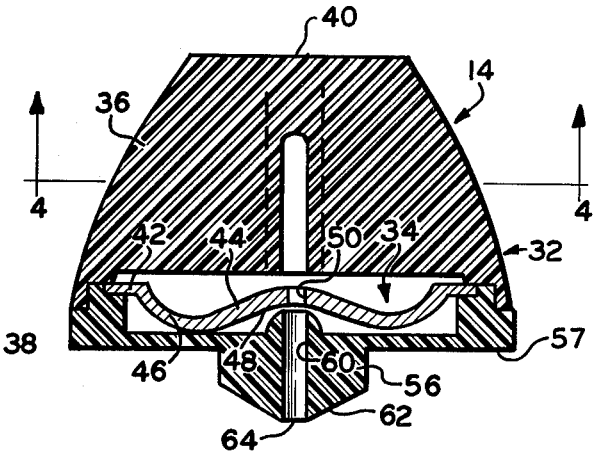
FIG. 3 is a front elevtional view in section of the reusable fastener of the present invention.
Figure 4:
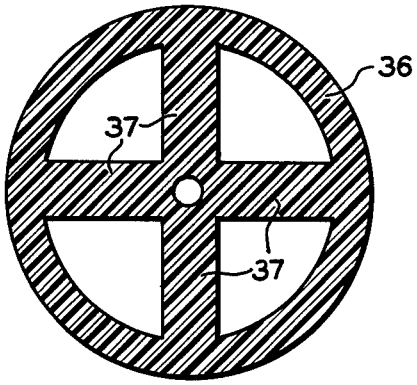
FIG. 4 is a sectional view of the reusable fastener of FIG. 3 taken along the line 4—4 in FIG. 3.
Figure 6:
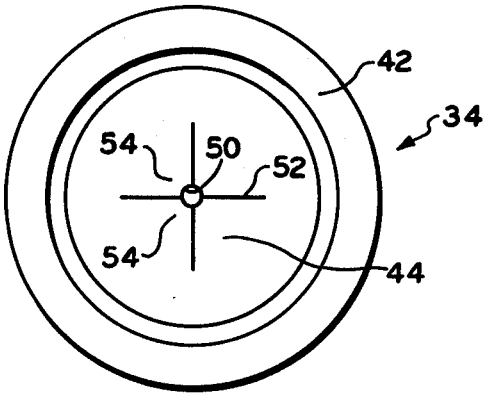
FIG. 6 is a top view of the spring steel clip of FIG. 5.
Figure 5:
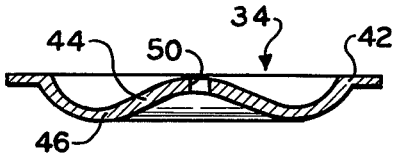
FIG. 5 is a front view in section of the spring steel clip of the present invention.
Figure 7:
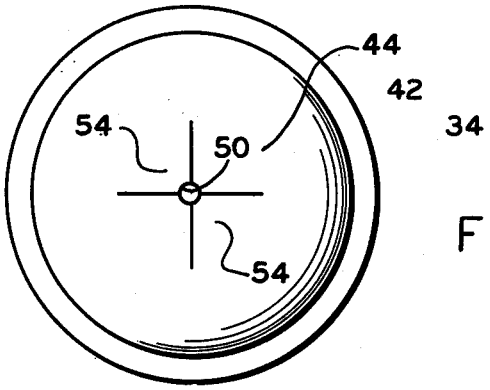
FIG. 7 is a bottom view of the spring steel clip of FIG. 5.

The monitor actuating system of the present invention may be seen by reference to FIGS. 1, 2 and 11. In FIG. 1 a monitored article A, such as an article of fabric clothing or other nondestructively pierceable object, is attached to a monitor actuating device 10 by means of a headed pin 12, such as a thumb tack, which pierces the article A, passes through the monitor actuating device 10 and on which reusable fastener 14 is attached preventing removal of the article A or the actuating device 10 from the pin 12. A floor plan of a typical store utilizing the monitor actuating system may be seen by reference to FIG. 11.

The headed pin 12, which may be in the form of a conventional tack or the like, comprises an enlarged head 16 and an axially extending shaft 18 of sufficient length to pierce the monitored article A, pass through the monitor actuating device 10 and be received by the fastener 14. The free end 19 of the shaft 18 opposite the head 16 is preferably pointed to facilitate piercing of monitored objects.

The monitor actuating device 10 includes a case 20 which is preferably tough and resilient to prevent vandalism and a sensor actuating member or means 22 encapsulated within the case. The sensor actuating member may be a magnet, a radio transmitter, a radio antenna or similar device as is well known in the art. A passage 24 through the actuating device is provided for passage of the pin shaft 18. It has been found that a plastic case 20 comprising two substantially identical sections 20A and 20B joined by ultrasonic welding as at 20C provides a monitor actuating device which is both durable and economically produced.

The reusable fastener 14 may be seen in greater detail by reference to FIGS. 3-7. The fastener 14 comprises a body 32 and a resilient spring steel clip 34 mounted therein. The body is preferably a two piece molded structure comprising an upper portion 36 and a lower cam portion 38 ultrasonically welded thereto. The upper portion 36 preferably has a relatively flat upper surface 40 for reasons to be discussed in detail below.

The resilient spring clip 34 includes a relatively flat circumferentially extending base portion 42 and a generally dome shaped portion 44. An intermediate portion 46 may connect the base portion and the dome shaped portion to properly axially align the base portion and dome shaped portion. The clip 34 is received within the body 32 such that the concave surface 48 of the dome shaped portion is towards the bottom cam portion 38 of the body. An aperture 50 is located generally at the center of the dome shaped portion. The aperture has a cross section somewhat smaller than the diameter of the shaft 18 of pin 12 when the dome shaped portion is in the non-deformed position. A plurality of generally radially extending slits 52 in the dome shaped portion intersect the aperture 50 to define a plurality of resilient spring fingers 54.

The lower cam portion 38 of body 32 includes an axially movable tubular member 56 about which an optional rubber gasket 58 or similar resilient gasket may be attached. The pin shaft receiving bore 60 is formed within the axially movable tubular member 56 and a cam surface 62 is formed on the exterior thereof. The cam surface is generally radially inwardly tapered away from the spring steel clip 34. It is noted that a radially inwardly directed pressure on cam surface 62 will tend to force axially movable member 56 towards concave surface 48 of the dome shaped portion 44 of the clip 34. The lower cam portion includes a generally flat bottom surface 57 from which tubular member 56 downwardly extends.

The resilient spring clip 34 is mounted within the body 32 such that the base portion 42 is axially fixed relative to the body and the concave surface 48 of the dome shaped portion 44 faces towards the opening 64 to the pin shaft receiving bore 60. The base 42 of the clip 34 is generally normal to the axis of bore 60. The base 42 of clip 34 is rotatable relative to the body. It is noted that axially movable tubular portion 54 is engageable with the concave surface 48 of the clip 34 and that axially upward motion of the axially movable tubular portion 54 relative to surface 40 will result in the fingers 54 being resiliently radially outwardly deformed with respect to the axis of bore 60 and define an aperture 50A of enlarged diameter and/or cross section, see FIG. 2.

As may be seen by reference to FIGS. 1 and 2, insertion of a pin shaft 18 into bore 60 will result in the shaft engaging the aperture deforming fingers 54 and deforming same to resiliently receive the pin shaft 18 as the shaft is inserted into the aperture. After insertion of the shaft 18, the fingers 54 will resiliently return towards the undeformed position and the radially inner edges of the fingers which define aperture 50 will engage and/or penetrate pin shaft 18 to retain fastener 14 on pin shaft 18. It is noted that attempts to simply axially force fastener 14 from pin shaft 18 will result in fingers 54 being further displaced radially inwardly to more tightly engage shaft 18.

A specially designed tool T is utilized to remove the reusable fastener 14 from the pin shaft 18 for authorized removal of the monitor actuating device 10 from the monitored article A. The tool T comprises a static pressure point member 70 having a flat surface 72 for engagement with the flat surface 40 of upper body portion 36 and at least two movable release jaws 74 which are selectively movable along a plane generally parallel to surface 72 towards and away from one another. The jaws have opposed tapered edges 76, generally complementary to the cam surface 62, which will engage the cam surface and force the axially movable portion 56 of the body towards the flat top surface 40 of upper portion 36 causing the axially movable portion 56 to engage the concave surface 48 and force the resilient fingers 54 radially outwardly for release of the pin shaft 18. As may be seen by reference to FIG. 4, the upper portion 36 of body 32 may include a plurality of reinforcement ribs 37 for axially fixing the base 42 of clip 34 with respect to the top surface 40 of the body 32.

It is noted that a force tending to axially remove the pin shaft 18 from the fastener 14 will cause the spring fingers 54 to engage the upper surface of axially movable tubular member 56 which will support the fingers 54 and prevent the collapse of same.

It is understood that the terms upper, lower, top, bottom, upward, downward and the like are used herein as illustrative terms referring to the drawings and are not intended to limit the scope of the present invention.

An alternate embodiment of the present invention may be seen by reference to FIGS. 8, 9 and 10. The monitor actuating device and reusable releasable fastener are similar in both operation and structure to that described in FIGS. 1-7 above. A pierceable monitored article A is captured on the shaft 118 of pin 112 extending from the free end of arm 101 by a fastener 114 which is mounted on the free end of arm 102 which is pivotably connected to arm 101 as at pivot axis 103. The release and engagement structure and mechanism of the fastener 114 is substantially identical to that of fastener 14 described above.

The faster 114 is generally encapsulated in a shell type member 105 which allows the fastener 114 to pivot relative to arm 102 for proper engagement with the pin shaft 118 which will assume various angles with respect to arm 102 as the result of relative pivoting motion between arms 101 and 102. It is noted that bending of pin shaft 118 is particularly undesirable as such bending will often render the fastener 114 non-removable from the pin shaft and/or non-reusable. A concave surface 106 on the fastener body 132 may be provided for engagement with convex surface 107 on the interior of the shell 105 to axially fix the fastener 114 relative to arm 102 while allowing pivoting motion of the fastener 114 relative to the arm 102.

A pair of ramp surfaces 108-108 on the exterior of the shell 105 engage cam surface 162 of the axially movable tubular member 156 to transmit radially inwardly directed forces to the cam surface. The opening 164 in the shell 105 to the shaft receiving bore 160 is elongated along a line perpendicular to the pivot axis 103 for proper, unobstructed receipt of the pin shaft 118 into the bore 160.

The monitor actuating member 122 may be encapsulated in either arm 102 or arm 101.

Although this invention has been described in its preferred embodiments with a certain degree of particularity, it is understood that the present disclosure of the preferred form is made by way of example and numerous changes and modifications in the details of construction and arrangement of the parts is possible withoug departing from the spirit and scope of the invention as hereinafter claimed.

I claim:

1. A reusable, releasable, tamper resistant fastener for attachment to the end of a shaft, said fastener comprising:

a generally hollow body having an upper portion and a lower portion, said lower portion defining a bore opening to the bottom surface of said lower portion for receipt of the shaft, said lower portion including a generally tubular member at least partially defining the bore adjacent the opening thereto, said tubular member axially movable relative to the upper portion, said tubular member having an outer cam surface tapered radially inwardly and towards the opening to the bore, radially inwardly directed force on said cam surface being effective to resiliently deform said lower portion to resiliently move said tubular member towards said upper portion; and a resilient one-piece spring steel clip mounted within said body, said clip having a base axially fixed and freely rotatable relative to said upper portion and a generally dome shaped portion having a generally concave inner surface and a generally convex outer surface arranged concave surface towards the opening to the bore, said dome shaped portion having an aperture therein generally coaxial with said bore and having a cross section having at least one dimension smaller than the cross section of the shaft, a plurality of generally radially extending slits in said dome shaped portion intersecting said aperture and dividing said dome shaped portion into a plurality of spring fingers adjacent said aperture, said fingers being resiliently radially outwardly deformable upon the application of an axial force to said concave surface to enlarge said aperture, said axially movable tubular member being engageable with said concave surface to resiliently radially outwardly deform said spring fingers upon resilient movement of said tubular member towards said upper portion.

2. The fastener of claim 1 wherein said clip is a one-piece stamping.

3. The fastener of claim 2 wherein said body comprises at least two molded pieces joined by ultrasonic welding.

4. The fastener of claim 3 wherein said upper portion includes a generally flat exterior surface diametrically opposed the opening to the bore.

5. The fastener of calim 2 wherein said aperture is generally round.

6. A reusable, selectively releasable, tamper-resistant fastener for attachment to the end of a shaft, said fastener comprising:

a generally hollow body having an upper portion and a lower portion, said lower portion defining a bore opening to the bottom surface of said lower portion for the receipt of the shaft, said lower portion including a generally tubular member at least partially defining the bore adjacent the opening thereto axially movable relative to the upper portion, said tubular member having an outer cam surface tapered radially inwardly and towards the opening to the bore, radially inwardly directed force on said cam surface being effective to resiliently move said member towards said upper portion; and a resilient one-piece spring steel clip mounted within said body, said clip having a base axially fixed and freely rotatable relative to said upper portion and a generally dome shaped portion having a generally concave inner surface arranged concave surface towards the opening to the bore, said dome shaped portion having an aperture therein generally coaxial with said bore and having a cross section having at least one dimension smaller than the cross section of the shaft, a plurality of generally radially extending slits in said dome shaped portion intersecting said aperture and dividing said dome shaped portion into a plurality of spring fingers adjacent said aperture, said fingers being resiliently radially outwardly deformable upon the application of an axial force to said concave surface to enlarge said aperture, said axially movable tubular member being selectively engageable with said concave surface upon resilient movement of said member towards said upper portion to radially outwardly resiliently deform said spring fingers.

7. The fastener of claim 6 wherein said body is formed of at least two molded pieces joined by ultrasonic welding, the upper exterior surface of said upper portion aligned with the axis of the bore including a flat surface generally normal to the axis of the bore.

8. A monitor actuating device attachment assembly comprising:

a monitor actuating device, a pin member attachable to the monitor actuating device having a shaft for piercing a monitored article; and a reusable, releasable, tamper-resistant fastener for selective attachment to the free end of the shaft of the pin member to capture the monitored article on the pin member shaft, said fastener comprising:

a body having an upper portion and a lower portion, said lower portion defining a bore opening to the exterior surface of the lower portion for receipt of the shaft, said lower portion including a member being axially movable relative to the upper portion and having an outer cam surface tapered radially inwardly and away from the upper portion, radially inwardly directed force on said cam surface being effective to resiliently move said axially movable member towards said upper portion; and a resilient spring steel clip mounted within said body, said clip having a base axially fixed and freely rotatable relative to the upper portion and a generally dome shaped portion defining a generally concave inner surface and a generally convex outer surface arranged concave surface towards the opening to the bore, said dome shaped portion having an aperture therein generally coaxial with said bore and having a cross section having a least one dimension smaller than the cross section of the shaft, a plurality of generally radially extending slits in said dome shaped portion intersecting said aperture and dividing said dome shaped portion into a plurality of spring fingers adjacent said aperture, said fingers being resiliently radially outwardly deformable upon the application of an axial force to said concave surface to enlarge said aperture, said axially movable member being engageable with said concave surface to resiliently radially outwardly deform said spring fingers when said member is resiliently moved towards said upper portion.

9. The assembly of claim 8 wherein said monitor actuating device comprises a molded shell encapsulating a monitor actuating means, said pin being integral with and extending from said shell.

10. The assembly of claim 8 wherein said pin is a headed tack and said monitor actuating device comprises a molded shell encapsulating a monitor actuating means, said shell defining a passage therethrough sized to receive said shaft.

11. The assembly of claim 8 wherein said pin extends from the free end of a first elongated member pivotably attached to a second elongated member, said fastener attached to the free end of said second elongated member, said shaft and said bore being substantially equally spaced from the pivot point, said monitor actuating device comprising a monitor actuating means encapsulated in one of said elongated members.

12. The assembly of claim 11 wherein said fastener is mounted for pivotal motion relative to said second elongated member.

13. The assembly of claim 12 wherein the opening to said bore is elongated along a line perpendicular to the pivot axis between said first and second elongated member.

14. A monitor actuating device attachment assembly comprising:

a pin member having a headed portion and a shaft, the free end of the shaft portion being pointed for piercing a monitored article, a monitor actuating device comprising a shell encapsulating a monitor actuating means, said shell having a passage therethrough sized to receive said shaft, and a reusable fastener for selective attachment to the free end of the shaft to capture said monitor actuating device and said monitored article on said shaft inbetween said headed portion and said fastener, said fastener comprising:

a generally hollow body having an upper portion and a lower portion, said lower portion defining a bore opening to the bottom of said lower portion for receipt of the shaft, said lower portion including a generally tubular member at least partially defining the bore adjacent the opening thereto axially movable relative to the upper portion, said tubular member having an outer cam surface tapered radially inwardly and towards the opening to the bore, radially inwardly directed force on said cam surface being effective to move said member towards said upper portion, the bottom of said lower portion of said body including a generally flat surface generally normal to the axis of said bore, a portion of said tubular member extending axially downwardly from said lower portion bottom surface of said cam surface located on that part of the tubular member extending downwardly from said lower portion bottom surface; and a resilient one-piece spring steel clip mounted within said body, said clip having a base axially fixed and freely rotatable relative to said upper portion and a generally dome shaped portion defining a generally concave inner surface and a generally convex outer surface arranged concave surface towards the opening to the bore, said dome shaped portion having an aperture therein generally coaxial with said bore and having a cross section having at least one dimension smaller than the cross section of the shaft, a plurality of generally radially extending slits in said dome shaped portion intersecting said aperture and dividing said dome shaped portion into a plurality of spring fingers adjacent said aperture, said fingers being resiliently radially outwardly deformable upon the application of an axial force to said concave surface to enlarge said aperture, said base being generally annular in cross section and the axis of rotation thereof being substantially coaxial with the axis of the bore and of said aperture, said axially movable tubular member being engageable with said concave surface to urge said fingers resiliently radially outwardly when said tubular member is moved axially upwardly toward said upper portion.

15. A monitoring system for detecting the unauthorized movement of an article out of a predetermined area, said system comprising:

a monitor actuating device which will actuate a monitor if moved beyond the boundries of the predetermined area;

a pin member attachable to the monitor actuating device having a shaft for piercing a monitored article;

a reusable fastener for selective attachment to the free end of the shaft to capture the monitored article on the shaft; and a specialized tool mounted at a point within the predetermined area, said fastener designed for release from said shaft only upon the use of said tool;

said fastener comprising:

a generally hollow body having an upper portion and a lower portion, said lower portion defining a bore opening to the bottom of said lower portion for receipt of the shaft, said lower portion including a generally tubular member at least partially defining the bore adjacent the opening thereto, said tubular member being axially movable relative to the upper portion, said tubular member having an outer cam surface tapered radially inwardly and towards the opening to the bore, radially inwardly directed force on said cam surface being effective to move said member towards said upper portion, the bottom of said lower portion including a generally flat bottom surface extending generally normally to the axis of the bore, a portion of said tubular member extending axially downwardly from said generally flat bottom surface, said cam surface being located on that portion of the tubular member extending downwardly from said generally flat bottom surface; and a resilient one-piece spring steel clip mounted within said body, said clip having a base axially fixed and freely rotatable relative to said upper portion and a generally dome shaped portion defining a generally concave inner surface and a generally convex outer surface arranged concave surface towards the opening to the bore, said dome shaped portion having an aperture therein generally coaxial with said bore and having a cross section having at least one dimension smaller than the cross section of the shaft, a plurality of generally radially extending slits in said dome shaped portion intersecting said aperture and dividing said dome shaped portion into a plurality of spring fingers adjacent said aperture, said fingers being resiliently radially outwardly deformable upon the application of an axial force to said concave surface to enlarge said aperture, said base being generally annular in cross section and the axis of rotation thereof being substantially coaxial with the axis of the bore, said aperture being generally coaxial with the axis of rotation of said base, said axially movable tubular member being engageable with said concave surface to urge said spring fingers resiliently radially outwardly when said tubular member is moved axially towards said dome shaped portion, said tool comprising a first member engageable with the top of said upper portion to prevent axial movement thereof and a pair of jaws selectively movable towards one another for selectively applying a radially inwardly directed force on said cam surface.

16. The system of claim 15 wherein said upper portion includes a generally flat upper exterior surface for engagement with said first member.

17. The system of claim 15 wherein said jaws have tapered surfaces on the opposed ends thereof generally complementary to said cam surface.

18. A reusable fastener for attachment to the end of a shaft, said fastener comprising:

a generally hollow body having an upper portion and a lower portion, said lower portion defining a bore opening to the bottom surface of said lower portion for receipt of the shaft, said lower portion including a generally tubular member at least partially defining the bore adjacent the opening thereto axially movable relative to the upper portion, said tubular member having an outer cam surface tapered radially inwardly and towards the opening to the bore, radially inwardly directed force on said cam surface being effective to move said member towards said upper portion, said lower portion of said body including a generlly flat bottom surface generally normal to the axis of the bore, a portion of said tubular member extending axially downwardly from said bottom surface, said cam surface being located on that portion of the tubular member extending axially downward from said bottom surface; and a resilient one-piece spring steel clip mounted within said body, said clip having a base axially fixed and freely rotatable relative to said upper portion and a generally dome shaped portion having a generally concave inner surface arranged concave surface towards the opening to the bore, said dome shaped portion having an aperture therein generally coaxial with said bore and having a cross section having at least one dimension smaller than the cross section of the shaft, a plurality of generally radially extending slits in said dome shaped portion intersecting said aperture and dividing said dome shaped portion into a plurality of spring fingers adjacent said aperture, said fingers being resiliently radially outwardly deformable upon the application of an axial force to said concave surface to enlarge said aperture, said axially movable tubular member being selectively engageable with said concave surface to radially outwardly resiliently deform said spring fingers.

* * * * *

UNITED STATES PATENT AND TRADEMARK OFFICE

CERTIFICATE OF CORRECTION

PATENT NO. : 4,104,622

DATED : 8/1/78

INVENTOR(S) : C.R.VanNiel

It is certified that error appears in the above-identified patent and that said Letters Patent are hereby corrected as shown below:

Column3, line 36: 10- should read---10-10---.

Col. 6, line 6: "withoug" should read "without".

line 58: "calim" should read "claim".

Col. 10, line 41: "generlly" should read "generally".

Signed and Sealed this

Sixth Day of March 1979

[SEAL]

Attest:

RUTH C. MASON
*Attesting Officer*

DONALD W. BANNER
*Commissioner of Patents and Trademarks*